US005136278A

United States Patent [19]

Watson et al.

[11] Patent Number: 5,136,278

[45] Date of Patent: Aug. 4, 1992

[54] COMPACT AND LIGHTWEIGHT PNEUMATIC PRESSURE DETECTOR FOR FIRE DETECTION WITH INTEGRITY SWITCH

[75] Inventors: Nigel S. Watson, Martinez; Shailer T. Pickton, Lafayette, both of Calif.

[73] Assignee: Systron Donner Corporation, Concord, Calif.

[21] Appl. No.: 669,918

[22] Filed: Mar. 15, 1991

[51] Int. Cl.[5] ..... G08B 17/04

[52] U.S. Cl. ..... 340/592; 340/626; 73/40.5 R; 200/81.4; 200/83 N

[58] Field of Search ..... 340/591, 592, 593, 584, 340/626, 945; 73/718, 753, 40.5 R; 337/299, 306, 307, 320, 321; 200/81.4, 83 N, 83 Y

[56] References Cited

U.S. PATENT DOCUMENTS 1,986,479 1/1955 Lowe ..... 340/592

3,234,537 2/1966 Lindberg ..... 340/592

3,760,393 9/1973 Lindberg ..... 340/592

*Primary Examiner*—Jin F. Ng

*Assistant Examiner*—Christine K. Oda

*Attorney, Agent, or Firm*—Flehr, Hohbach, Test, Albritton & Herbert

[57] ABSTRACT

A pneumatic pressure detector for use in an overheat or fire alarm system utilizes a known capillary type sensor tube which has absorbed in it a gas. Overheat or fire condition causes the gas to expand which then actuates an associated deformable diaphragm to close an electrical switch. To insure that the system pressure is maintained and no fault condition exists, the compact detector also uses a deformable diaphragm associated with an integrity switch which opens if the pressure falls below normal. Both of these diaphragms are juxtaposed to form the plenum to which the sensor tube is attached thereby saving weight and space.

6 Claims, 3 Drawing Sheets

COMPACT AND LIGHTWEIGHT PNEUMATIC PRESSURE DETECTOR FOR FIRE DETECTION WITH INTEGRITY SWITCH

The present invention is directed to a pneumatic pressure detector and more specifically to a detector for use in a fire alarm system having a sensor tube pressurized with a gas.

BACKGROUND OF THE INVENTION

The foregoing type of fire alarm system is well-known as schematically illustrated in FIGS. 1 and 2. In such a system, as illustrated by the dashed outline, there is a responder assembly 10 and a sensor tube 11. Such sensor tube 11 may be several feet long and is placed in the compartment of an aircraft where fire or overheat conditions are detected. The sensor tube is shown in enlarged detail in FIG. 2 and includes a core element 12 which stores hydrogen gas and is spiral wrapped to allow a gas path in the event of sensor damage such as crushing or kinking. Then the wall 13 encloses the core but has sealed in pressurized helium gas.

The responder assembly 10 to which sensor tube 11 is connected basically has a gastight plenum 15 to which capillary tube 11 is connected. In a prior fire detector system sold as a Model 801-DRH by Systron Donner Corporation, the present assignee, plenum 15 was actually formed of two separate units Each unit contained either an alarm switch 14 or an integrity switch 16. The alarm switch 14 which is normally opened would close on an overheat or fire condition. This would be caused by an increase in gas pressure 11 which would force the diaphragm 17 against the contact designated 1. Similarly, if the sensor tube 11 was cut, which would release its gas pressure, the diaphragm 18 which is normally closed against the contact designated 3 would open signifying failure of the system.

The remainder of the detector includes electrical circuitry connected to terminal 1 to provide a 28-volt DC voltage, terminal 2 which provides an alarm signal which is connected to metallic diaphragms 17 and 18 whenever one switch closes and the other switch opens, and terminal 3 which is a system test. The diaphragm switches 14 and 16 controlled by a sensor tube 11 is generally disclosed in one of many Lindberg, Jr. patents, a typical one of which is 3,122,728.

In operation in general, ambient helium gas pressure in the sensor tube 11 is directly related to average temperature in, for example, an engine compartment of an airplane. Engine compartment overheat causes a proportionate rise in gas pressure. When the compartment temperature rises to the factory set alarm rating, the rising gas pressure closes the sensor alarm switch 14. When compartment cooling reduces the gas pressure the alarm switch opens and is ready to respond again. For indication of an actual fire rather than overheat conditions, hydrogen gas in the core 12 (FIG. 2) is released to close the alarm switch. Lastly when the sensor tube 11 is cut, the helium gas escapes and the integrity switch 16 opens.

To structurally implement the showing of FIG. 1, the above-mentioned detector Model 801-DRH utilized two separate side-by-side responder assemblies, each including its own separate plenum and diaphragm switch, which then were connected to a common sensor tube.

Since this detector is for aircraft applications, minimization of both weight and size is important.

OBJECT AND SUMMARY OF THE INVENTION

It is therefore a general object of the invention to provide an improved pressure detector.

In accordance with the above object, there is provided a pneumatic pressure detector for use in an overheat or fire alarm system having a sensor tube pressurized with a gas, the detector including alarm means responsive to an increase in pressure of the gas in the sensor tube for indicating a fire or overheat condition, and also having integrity means for indicating a fault condition of a decrease in gas pressure in the detector. The detector comprises a substantially cylindrical container including a gastight plenum having an axis, having first and second opposite ends along the axis. The first end with respect to the axis carries the alarm means and comprises a first deformable diaphragm normally spaced from a first electrical contact which is located outside of the plenum. The first diaphragm is responsive to greater pressure to move towards the contact to give the alarm. The second end carries the integrity means which comprises a second deformable diaphragm normally in contact with a second electrical contact located outside of the plenum. The first and second diaphragms are juxtaposed and form between them the gastight plenum which is connected to the sensor tube and is at the same gas pressure. The second diaphragm is responsive to less gas pressure to move away from the second contact to provide the fault indication.

BRIEF DESCRIPTION OF DRAWINGS

FIG. 4 best illustrates the functioning of the present invention. With the terminals 1, 2, and 3 being indicated, as already discussed in FIG. 1, along with a portion of sensor tube 11, the responder assembly of FIG. 4 is in effect therefore the responder assembly 10. It includes a substantially cylindrical container 21 which has an axis which is coincident with the conductors 1 and 3. The first end of the container 21 in the form of the disc 22 carries the deformable circular diaphragm 17 which is brazed at its ends to the disc 22. The other second end of container 21 includes the disc 23 which carries the deformable diaphragm 18. It is noted that conductor 3 is in normal contact with diaphragm 18 because of the ambient gas pressure within the plenum chamber effectively formed by the juxtaposed diaphragms 17 and 18. The remainder of the plenum is formed by the apertured center plate 24 and two adjacent annular rings 26 and 27. A gas seal is made by brazing the rings 26 and 27 to the center plate 24 and discs 22 and 23.

In accordance with well-known design both the conductors 1 and 3, include sealed off capillary sensors, for example, tubes, one is shown at 28 and the other schematically at 29, which apply pressure to the other sides of the diaphragms 17 and 18 to form in effect second and third plenums for the purpose of normalization of ambient conditions and/or to serve a reference standard. Conductor 3 runs, of course, through the end housing 32.

Figure 1:
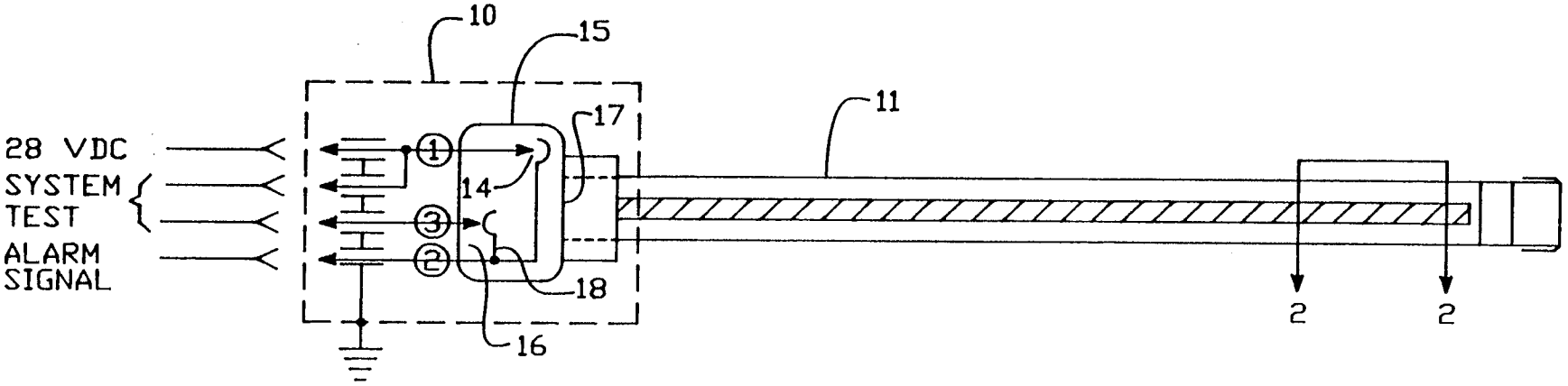
FIG. —1 (PRIOR ART)
FIG. 1 is a schematic diagram of a detector embodying the present invention showing conceptually the prior art detector.
Figure 2:
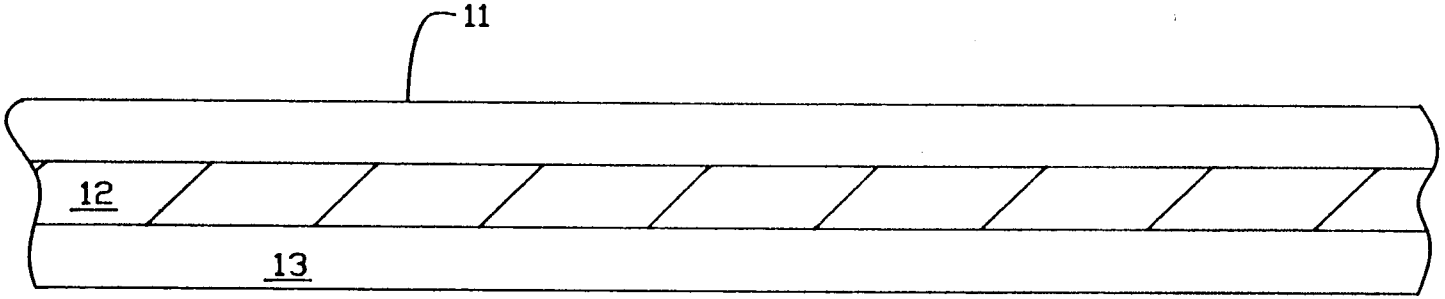
FIG. —2 (PRIOR ART)
FIG. 2 is an enlarged view of a portion of FIG. 1 taken substantially along the line 2—2.
Figure 5:
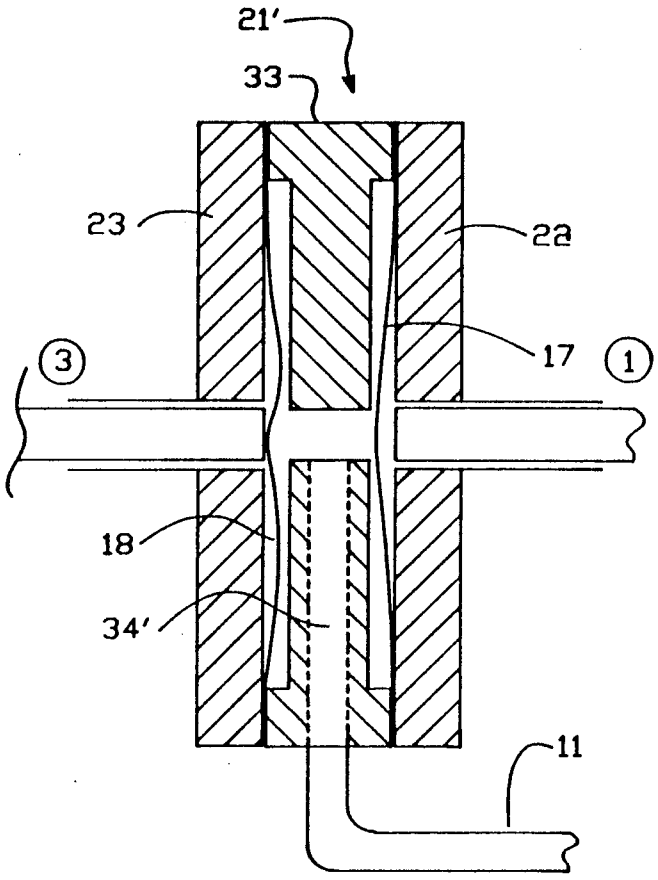
FIG. 5 is a cross-sectional view showing an alternative embodiment of FIG. 4.

FIG. 5 illustrates an alternative design of the cylindrical housing 21' where instead of the use of three-part spacers between the end plates 22 and 23, a single T-shaped spacer 33 is used. This means that only brazing is needed in only two locations rather than four as in FIG. 1.

In any case, both the spacers 24 and 33 include the apertures 34 and 34' through which the sensor tube 11 extends to pressurize the plenum tube to a standard operating pressure and also to allow the alarm diaphragm 17 to sense overheat or fire conditions.

Figure 3:
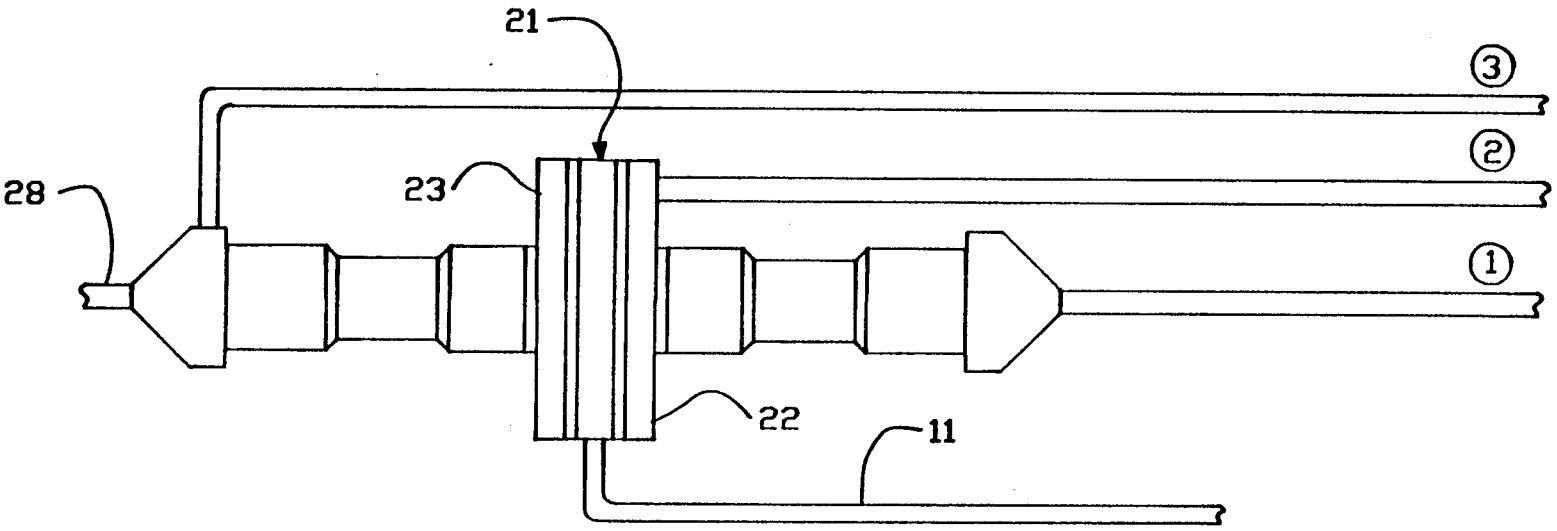
FIG. 3 is an elevational view of a detector embodying the present invention.
Figure 4:
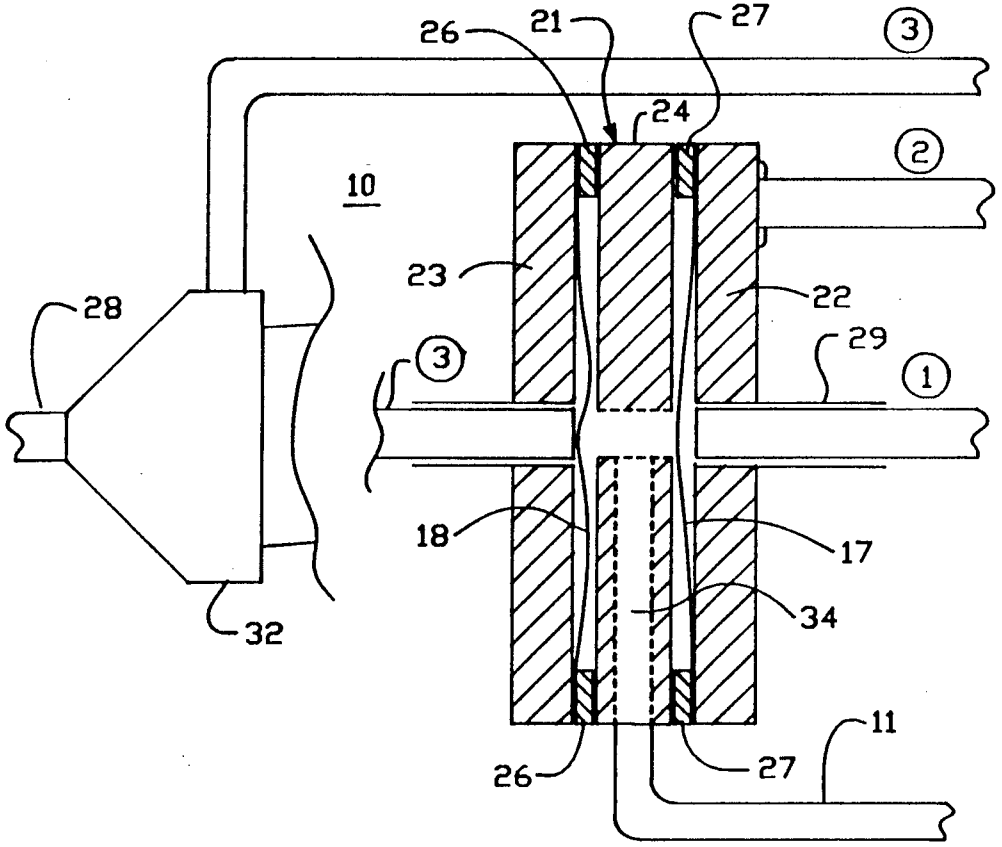
FIG. 4 is a simplified cross-sectional view of FIG. 3, which is partially cut away.

FIG. 3 is an elevational view showing FIG. 4 as it would appear before being packaged in an overall container with proper terminal connections for the electrical terminals 1, 2, and 3. With the use of this back-to-back type of structure, incorporating both an alarm switch and an integrity switch in a common plenum with the diaphragms being juxtaposed, significant weight and size savings are achieved; for example, compared to the prior model, the weight is reduced by substantially more than one-half, and the size by one-quarter. Thus, an improved pneumatic pressure detector for use in overheat or fire alarm systems has been provided.

What is claimed is:

1. A pneumatic pressure detector for use in an overheat or fire alarm system having a sensor tube pressurized with a gas, the detector including alarm means responsive to an increase in pressure of the gas in the sensor tube for indicating a first or overheat condition and also having integrity means for indicating a fault condition of a decrease in gas pressure in said detector comprising:

a substantially cylindrical container including a first gastight plenum, having an axis, having first and second opposite ends along the axis, the first end with respect to said axis carrying said alarm means and comprising a first deformable diaphragm normally spaced from a first electrical contact located outside of said first plenum, said first diaphragm being responsive to greater pressure to move towards said first contact for indicating said first or overheat condition;

said second end carrying said integrity means comprising a second deformable diaphragm normally in contact with a second electrical contact located outside of said first plenum, said first and second diaphragms being juxtaposed and forming between them said first gastight plenum which is connected to said sensor tube at the same gas pressure;

said second diaphragm being responsive to less gas pressure to move away from said second contact for indicating said fault condition.

2. The pressure detector as in claim 1 where said first and second electrical contacts are coaxial with said axis.

3. The pressure detector as in claim 1 where said first and second diaphragms are brazed to annular spacer means, such means including an aperture through which said sensor tube is connected to said first plenum.

4. The pressure detector as in claim 1 where the sides of said first and second diaphragms outside of said first plenum are connected to second and third plenums respectively, said second and third plenums having included a sealed off capillary tube for normalization of ambient conditions.

5. The pressure detector as in claim 1 where said first and second diaphragms are connected to a single T-shaped annular spacer.

6. The pressure detector as in claim 3 where said annular spacer means includes a center plate with an aperture for said sensor tube and two adjacent annular rings for sealing.

* * * * *